US005497531A

United States Patent [19]

Kuhrau et al.

[11] Patent Number: 5,497,531

[45] Date of Patent: Mar. 12, 1996

[54] MANIFOLD FOR USE WITH A CIRCULAR SLIVER KNITTING MACHINE

[75] Inventors: Michael K. Kuhrau, Orangeburg; John C. Knight, Sr, North, both of S.C.

[73] Assignee: Mayer Industries, Inc., Orangeburg, S.C.

[21] Appl. No.: 385,119

[22] Filed: Feb. 7, 1995

Related U.S. Application Data

[62] Division of Ser. No. 214,609, Mar. 17, 1994.

[51] Int. Cl.[6] ..... D04B 35/32

[52] U.S. Cl. ..... 15/345; 15/346; 66/168

[58] Field of Search ..... 15/301, 345, 346; 66/168

[56] References Cited

U.S. PATENT DOCUMENTS

| | | | |
|---|---|---|---|
| 2,238,541 | 4/1941 | Spagnolo | 15/346 X |
| 2,280,535 | 4/1942 | Moore . | |
| 2,953,912 | 9/1960 | Hill . | |
| 3,226,952 | 1/1966 | Cassady . | |
| 3,295,337 | 1/1967 | Beucus et al. . | |
| 3,299,672 | 1/1967 | Schmidt . | |
| 3,710,597 | 1/1973 | Schmidt . | |
| 3,728,872 | 4/1973 | Thore . | |
| 4,006,609 | 2/1977 | Abler . | |
| 4,050,267 | 9/1977 | Schaab et al. . | |
| 4,187,700 | 2/1980 | Koegel . | |
| 4,244,198 | 1/1981 | Schaab et al. . | |
| 4,245,487 | 1/1981 | Schaab et al. . | |
| 4,364,243 | 12/1982 | Kunde . | |
| 4,532,780 | 8/1985 | Tilson et al. . | |
| 4,563,884 | 1/1986 | Kunde et al. . | |
| 4,884,315 | 12/1989 | Ehnert | 15/346 |
| 5,134,863 | 8/1992 | Hanna . | |
| 5,379,614 | 1/1995 | Igarashi | 15/301 X |

FOREIGN PATENT DOCUMENTS

| | | |
|---|---|---|
| 1097092 | 3/1981 | Canada . |
| 1108883 | 9/1981 | Canada . |
| 2817130 | 2/1978 | Germany . |
| 710949 | 7/1966 | Italy . |
| 1528827 | 3/1988 | U.S.S.R. . |
| 807049 | 1/1959 | United Kingdom . |

OTHER PUBLICATIONS

*High Tech for High Pile* (brochure), Mayer Wildman Industries, Inc. 3KPC9/87.

*Primary Examiner*—Chris K. Moore

*Attorney, Agent, or Firm*—Bell, Seltzer, Park & Gibson

[57] ABSTRACT

An apparatus and method for knitting sliver fabric on a circular sliver knitting machine. An air blowing unit is attached to the machine so as to be oriented radially inward from the knitting cylinder and a card unit so as to blow air radially outwardly toward the needles. The air blowing unit blows air along generally horizontal longitudinal path toward the needles so as to turn free ends of the sliver fibers once the medial portions thereof have been knit into the fabric. A modified latched guard cooperates with air blowing unit for guiding free ends of the sliver fibers onto sinkers in a uniform and controlled manner to enable the free ends sliver fibers to be knit a second time by the adjacent needles.

4 Claims, 11 Drawing Sheets

MANIFOLD FOR USE WITH A CIRCULAR SLIVER KNITTING MACHINE

This application is a divisional of application Ser. No. 08/214,609, filed Mar. 17, 1994.

FIELD OF THE INVENTION

The present invention relates to the field of sliver knitting, and, more particularly to, an apparatus and method for knitting reverse loop sliver knit fabric.

BACKGROUND OF THE INVENTION

The manufacture of reverse loop sliver knit fabric using a circular sliver knitting machine for producing a pile fabric is well known in the art. Typically, a doffer roll is used to receive the sliver fiber from a card unit. Needles mounted on a rotatable cylinder receive the sliver fibers from a doffer roll as hooks on the needles enter the fillet wire of the doffer roll and draws sliver fibers after the needles have risen to a clearing level along a predetermined wave-like path. The hooks of the needle also pick up a yarn which is used to anchor or secure the sliver fibers such that free ends of the sliver fibers project from one side of the fabric. Examples of this approach to knitting pile fabric may be seen in U.S. Pat. Nos. 3,299,672 and 3,710,597 to Schmidt.

A variation on this approach is set forth in U.S. Pat. No. 3,226,952 to Cassady which discloses the use of a jet of air to position sliver fibers and hold it in position by means of a sinker nib for forming a single-faced pile fabric. As shown in Cassady, the air nozzle is located radially outward of the needle cylinder and at a position diagonal to the sinkers and needles.

In U.S. Pat. No. 2,280,535 Moore introduced the use of a suction nozzle in an attempt to obtain a two-faced pile fabric. In Moore, the suction nozzle was positioned radially inward from the needles for drawing the free ends of the sliver fiber inward between shanks of the plurality of needles and below the held loops, which, in combination with the rotation of the needle cylinder, tended to wind the free ends about the shank of the needles resulting in two-faced pile fabric.

Schaab et al. in U.S. Pat. Nos. 4,244,198 and 4,245,487 which have been assigned to the Assignee of the present invention disclose a method and apparatus for making reverse loop sliver knit fabric which is a significant departure from the traditional manufacturing techniques described above. The traditional manufacturing method reverse loop sliver knit fabric resulting in a single knitting of the sliver fibers into the base fabric. This results in a pile fabric which is both long and has an uneven length. It is therefore necessary to finish the product by shearing the pile to the desired height and napping or brushing the sheared pile to minimize any flaws in the fabric.

Schaab et al. knit the sliver fabric into a typical J-loop or U-loop on the first pass of the needles in accordance with the previously described techniques. However, unlike previous methods, Schaab, et al. use an air nozzle which is positioned radially inward from the needles and sinkers. The purpose of the air nozzle is to turn the free ends of the sliver, previously knitted into the base fabric during the first pass of the needles, over the sinkers so that the remaining free ends, assuming that they are of sufficient length, will be knitted a second time or interlaced into the fabric. The result is that the length of the free ends remaining after the second pass is shortened and as a consequence, the pile will be shorter, therefore, less waste will occur as result of shearing.

Unfortunately, the arrangement of the air nozzle used in Schaab et al. is such that the free ends of the sliver can be blown radially backward causing the free ends of the sliver to stand almost vertically in the area between the needles and the sinker units. This vertical orientation makes it difficult for the needles to capture and retain the free ends of the sliver for purposes of interlacing them into the fabric. As a consequence, the resultant fabric does not have a uniform length and still requires shearing of a large portion of the pile prior to use. The ability to control the orientation and positioning of the free ends of the sliver over the sinkers so that the free ends of the sliver may be knit a second and possibly a third time is important to manufacturing a consistent and uniform reverse loop sliver knit fabric.

In addition, by using an air jet similar to the one disclosed by Schaab et al., much of the fiber waste generated by the knitting process is blown away from the centrally located exhaust unit and outside of the circular sliver knitting machine. Consequently, much of the fiber waste is blown into the atmosphere rather than being collected. An unclean environment surrounding the machine occurs, which may result in fiber waste being interlaced with the sliver fibers causing the quality of the fabric to decrease because of the impurities.

SUMMARY OF THE INVENTION

In view of the foregoing background, it is therefore an object of the present invention to provide a circular sliver knitting machine which results in a more efficient sliver knitting machine which produces a reverse loop sliver knit fabric which requires little or no shearing and decreases associated production waste by as much as sixty (60) percent.

These and other objects, features and advantages of the present invention are obtained by providing a circular sliver knitting machine having a frame which rotatably support a needle cylinder. A plurality of needles are supported in said needle cylinder for rotational movement therewith and for vertical movement parallel to the axis of rotation thereof. A plurality of card units are provided at radially spaced locations along the rotational path of the needle cylinder. Each card unit is positioned to deliver sliver fibers to the needles during their rotation with the needle cylinder. A yarn feeding station is positioned adjacent each of the card units for selectively feeding yarn to the plurality of needles. A plurality of sinkers are also provided which cooperate with the plurality of needles to form the yarn and the sliver fibers into knitted fabric.

The circular sliver knitting machine is also provided with an air blowing unit which cooperates with each of the plurality of card units for blowing air along a generally horizontally longitudinal path radially outward toward the plurality of needles for turning free ends of the sliver fiber over onto the plurality of sinkers.

The air blowing unit of the present invention preferably includes a nozzle which defines an air passageway for blowing air onto the plurality of needles. A block is used which defines an aperture adapted to receive the nozzle and cooperates with an air supply for supplying air to said nozzle. It is preferable that the block be attached to the circular sliver knitting machine so that the block may be moved to control the horizontal distance between the air nozzle and the plurality of needles. In addition, it is beneficial to have the nozzle be selectively rotatably movable about the nozzles longitudinal axis for selective adjustment of its rotational orientation relative to the plurality of needles.

As would be readily understood by those skilled in the art, the use of a first suction means radially outward from the air blowing unit is beneficial to controlling fiber waste generated by the circular sliver knitting machine. This is especially true because of the positioning of the air blowing unit. Unlike prior air blowing units which blow air radially inward toward the center of the machine, the present air blowing unit blows air radially outward. Therefore the use of a first suction means, preferably attached to each of the plurality of card units is helpful in controlling fiber waste generated by the machine.

Another aspect of the invention facilitates simultaneous movement of the air blowing unit relative to the plurality of needles. The initial calibration or adjustment of the air unit relative to the plurality of air nozzles in the horizontal and rotational direction having been previously described, it is also necessary for production of quality fabric and for producing various kinds of fabric to vary the lateral and the longitudinal or elevational relationship of the air blowing unit relative to the plurality of needles. To make such adjustments for each individual air blowing unit under current techniques is not only time consuming, but also results in a significant amount of wasted material during the calibration process. Accordingly, it is preferable from a cost and time saving perspective to be able to simultaneously adjust all air blowing units relative to the plurality of needles.

In the present invention, this is achieved by having a support ring, adapted to receive the air blowing units, the support ring is cast or formed with an exhaust hood which forms a second suction means. The second suction means sucks waste fiber laden air from a region of the circular sliver knitting machine radially inward from the air blowing units. The preferred arrangement is for the exhaust hood to have a tube adjusting portion affixed thereto. The tube adjusting portion and the exhaust hood desirably contain corresponding horizontal grooves along a predetermined distance thereof which enables lateral movement of the exhaust hood relative to the tube adjusting portion. A tightening means is received within the horizontal grooves for selectively tightening the exhaust hood in a predetermined position relative to the tube adjusting portion.

In addition, it is beneficial for the tube adjusting portion to have a threaded outer surface. An attachment portion is attached at one end to the bottom of the air directing means and at the other end to the tube adjusting portion. An adjusting ring control the adjusting system by having a first end longitudinally fixed and rotatably engaging the tube adjusting portion, and having a second end threadingly cooperating with a threaded outer surface of the tube adjusting portion for adjusting longitudinal movement of the exhaust hood in response to rotational movement of the adjusting ring relative to the tube adjusting portion. It is this movement of the exhaust hood both laterally and vertically which moves the support ring attached thereto, which in turn simultaneously moves the blowing units to the desired position relative to the plurality of needles.

It is also beneficial to the operation of the adjustment system if the attachment portion defines a longitudinal channel which cooperates with a tube connector attached to the tube adjusting portion for defining a predetermined range of longitudinal adjustment of the exhaust hood.

In addition to controlling the quality and type of fabric produced on the circular sliver knitting machine by movement of the air blowing units, it is also possible to control the quality and type of fabric produced by controlling the air flow to the individual air blowing units. Preferably, a control means such as a variably adjustable valve is positioned between the air supply means and the air blowing means for controlling the air flow the air blowing means ranging between a CLOSED position and an ON position. It is also beneficial to control the pressure of the air flow in the air supply so that when the valve is in the ON position the desired air flow is achieved.

As a result of moving the air blowing unit radially inward from the plurality of needles and blowing air radially outward toward the plurality of needles, it is advantageous to modify the base of the plurality of card units to limit waste fibers from being trapped behind the doffer roll. The base is preferably modified so that it has a generally flat base parallel to the suction nozzle so that they are on the same plane. In addition, it is helpful to have a notch placed in the base, corresponding to a similar notch in the suction nozzle to improve movement of waste fiber from the plurality of card units into the housing to be discharge from the circular sliver knitting machine downstream.

To enhance the removal of fiber waste into the suction nozzle and to minimize fiber waste being trapped in gaps between the plurality of sinker units, it is preferred if the sinker units are laterally offset from the air blowing units so that the air flow travel over a latch guard adjacent the needles and a center region of the sinker units rather than over the gaps between sinker units.

A feature of the present invention which has been found to be very beneficial in controlling the quality of the sliver fabric is the use of latch guards which have been modified to cooperate with the air blowing units. The latch guard has an angles section such that the angle approaches 45° as is the angled section of the corresponding sinker units. These angled sections result in a camming action which guides the free ends of the sliver fibers, which are simultaneously being turned by the air blowing units, in a uniform manner over the sinkers at an angle approaching 45° behind the plurality of needles. The advantage of this system is that the free ends of the sliver fibers can then be uniformly knit into the base fabric resulting in a quality fabric having a substantially uniform loop height, minimizing the need for shearing and minimizing the associate waste.

A method aspect of the present invention is for producing a reverse loop sliver knit fabric on a circular sliver knitting machine of the type having a frame for rotatably supporting a needle cylinder, a plurality of sliver fibers and yarn feeding stations, and a plurality of needles movable between a clearing level and a cast-off level. Sinkers cooperate with the plurality of needles for knitting a fabric. The preferred method requires feeding sliver fibers and yarn to the plurality of needles as the needles travel along their rotational path with the needle cylinder. A medial portion of the sliver fibers and yarn is knitted to tie down or anchor the medial portion of the sliver fibers to form a first course, such that free ends of the sliver fibers extend therefrom adjacent the plurality of needles. After a second course is knit similar to the first course, air is blown along a generally horizontally longitudinal path, radially outward toward the plurality of needles, as the needles ascend toward the clearing level, to turn the free ends of both courses of sliver fibers. Free ends of both courses of the sliver fibers are then diagonally guided against a surface to lay the free ends onto the plurality of sinkers at an angle approaching 45°, as the plurality of needles continue ascending toward the clearing level. After which, the free ends of both courses of the sliver fibers are knitted by subsequent needles into the fabric. This method is preferably performed using the circular sliver knitting machine previously discussed.

BRIEF DESCRIPTION OF THE DRAWINGS

Some of the objects, features and advantages of the present invention having been stated, others will appear as the description proceeds, when taken in conjunction with accompanying drawings in which.

DESCRIPTION OF THE PREFERRED EMBODIMENT

The present invention will now be described more fully hereinafter with reference to the accompanying drawings, in which the preferred embodiment of the invention is shown. This invention may, however, be embodied in different forms and should not be construed as limited to the embodiments set forth herein. Rather, the illustrative embodiment is provided so that this disclosure will be thorough and complete, and will fully convey the scope of the invention to those skilled in the art. Like numbers refer to like elements throughout.

Overview Of The Circular Sliver Knitting Machine

Figure 1:
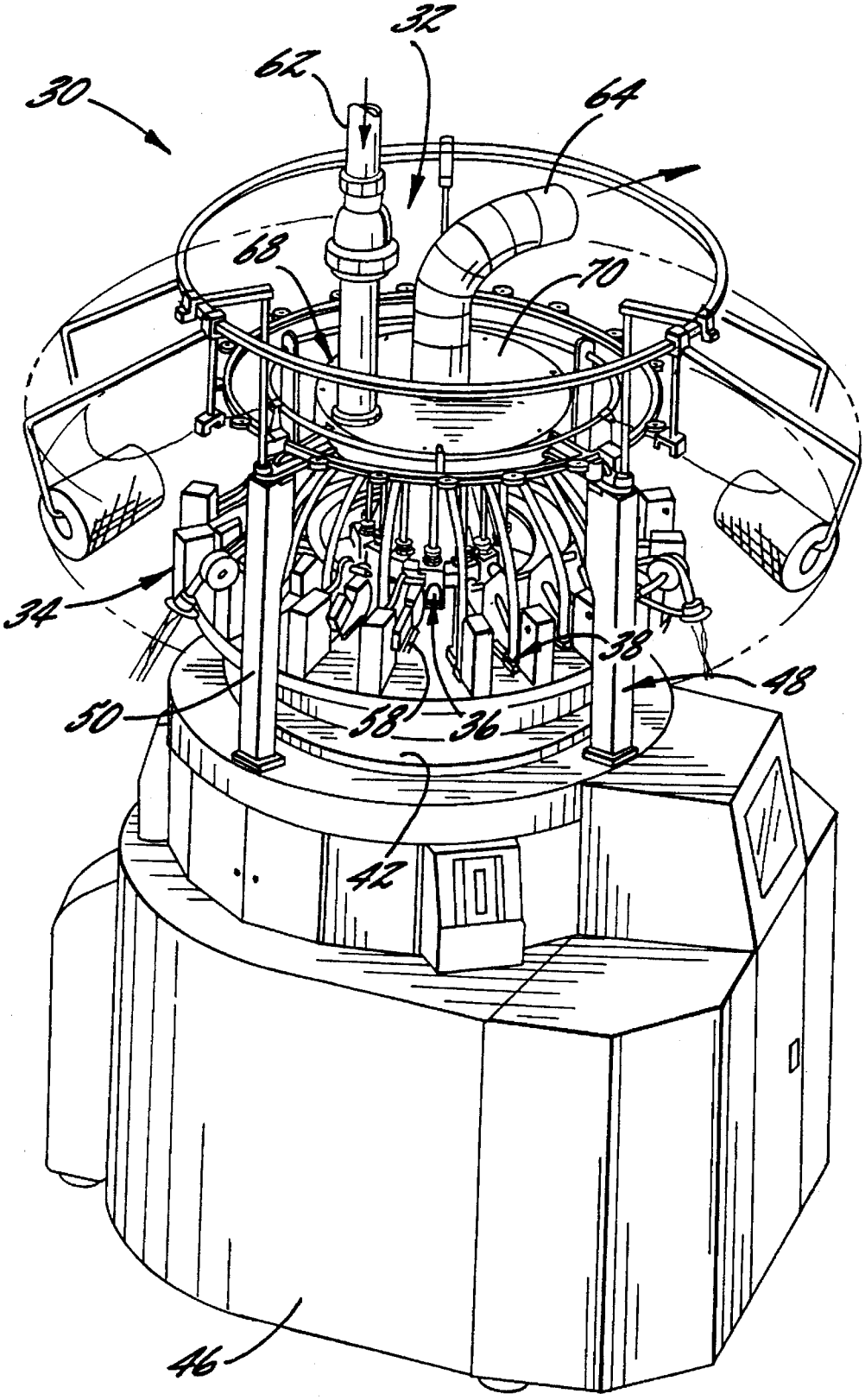
FIG. 1 is a perspective view of the apparatus in accordance with the present invention.
Figure 2:
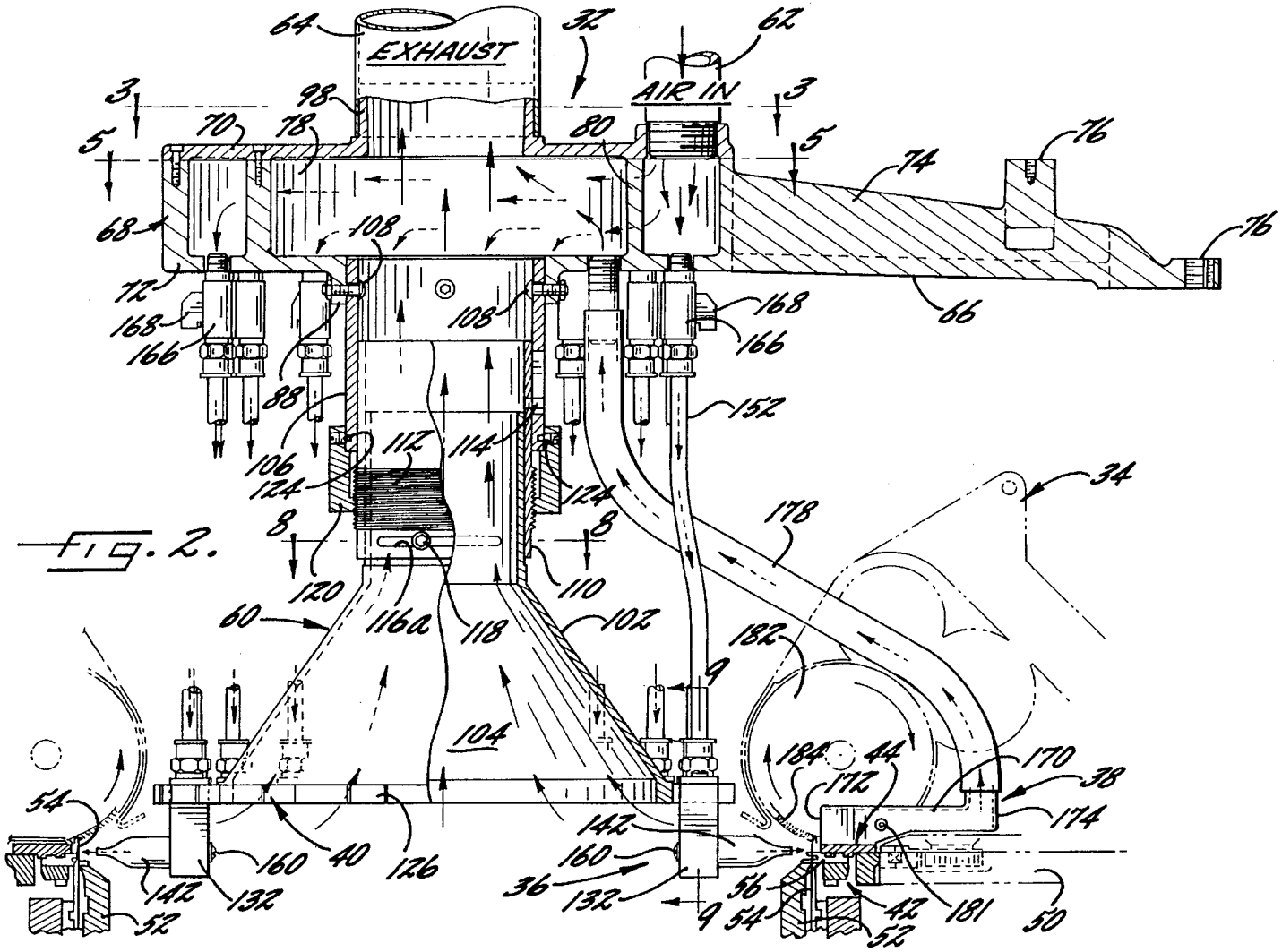
FIG. 2 is a partial cross sectional view taken along the line 2—2 of FIG. 1.
Figure 3:
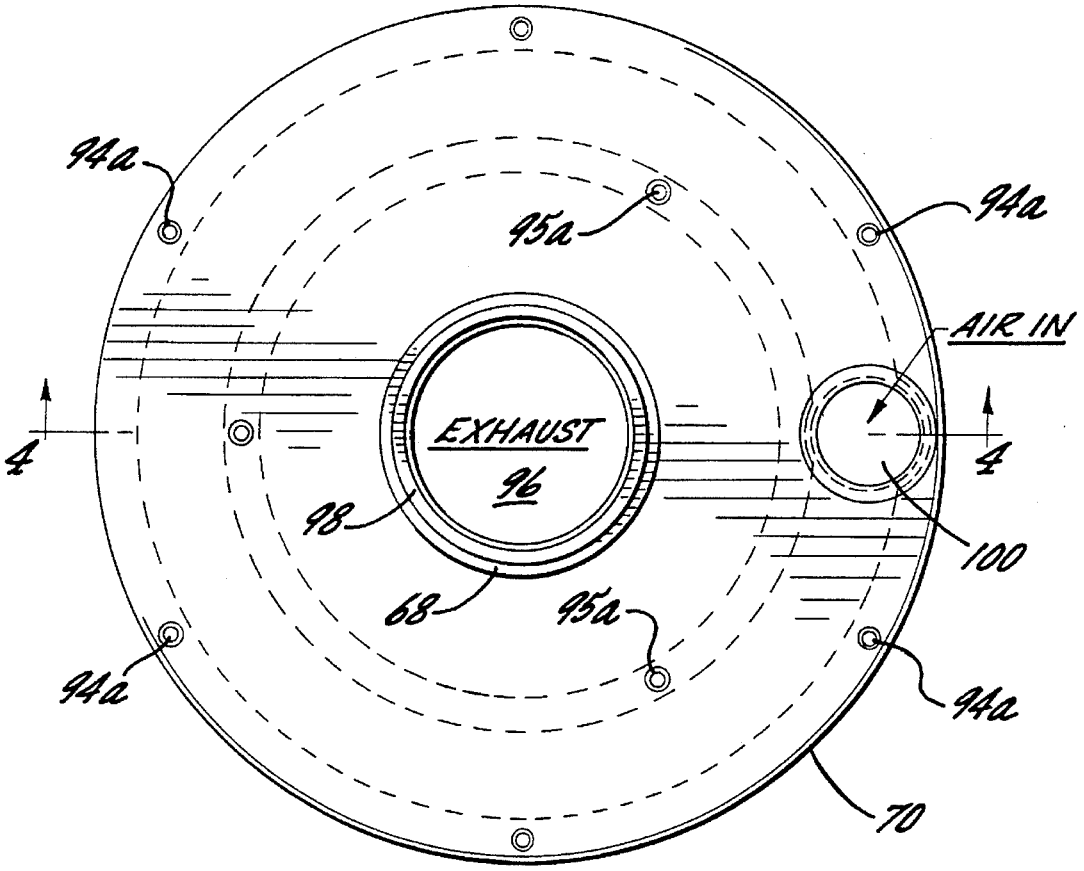
FIG. 3 is a top plan view of the cover taken along the line 3—3 of FIG. 2.
Figure 4:
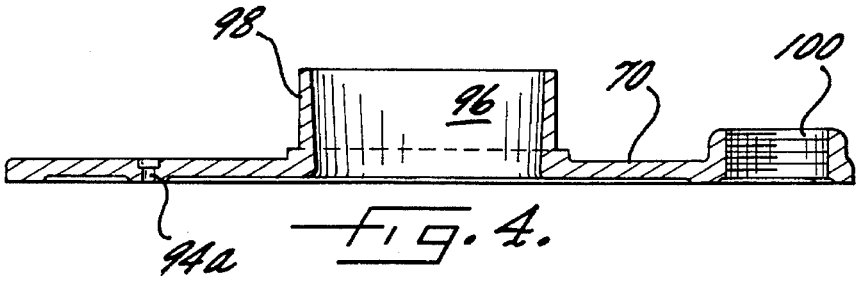
FIG. 4 is a cross sectional view taken along the line 4—4 of FIG. 3.

Referring to FIGS. 1 and 2, a circular sliver knitting machine which embodies the features of the present invention is illustrated generally at 30. The machine 30 consists of an air directing assembly 32, a plurality of card units 34, a plurality of air blowing units 36, a plurality of first suction units 38, an adjustment assembly 40, and a sinker units/latch guard assembly 44. The machine 30 also includes a base 46 which supports the above recited elements on a frame 48 consisting of six substantially equally spaced stanchions 50 extending upwardly from the base 46 and a frame plate 42 mounted thereto.

A needle cylinder 52 is rotatably mounted to the machine 30 for rotatably carrying a plurality of needles 54 about an axis parallel to the longitudinal axis of the machine. The needles 54, revolving with the needle cylinder 52, move vertically along a predetermined sinusoidal or wave-like path (shown in FIG. 17) relative to the card units 34, the blowing units 36, the first suction units 38, and the sinker units/latch guard assembly 44 which are each positioned in spaced locations around the machine 30. The needles 54 are movable between a welt position or clearance level and a knit position or cast-off level. In addition, the needles 54 used in the machine 30 have a short latch, thereby shortening the distance between the needles and the sinker units and latch guard assembly 44.

A plurality of sinkers 56 move generally perpendicular to the vertical movement of the needles 54 and cooperate therewith. Mounted on the frame 48 adjacent each of the card units 34, which feeds sliver fiber X to the needles 54 is a yarn feeding station 58 which feeds yarn Y to the needles 54. An exhaust unit 60 is provided for drawing or sucking fiber waste generated during the manufacturing process, out of the machine 30. Each of the elements briefly outlined above will be described below in greater detail.

The Air Directing Assembly

The air directing assembly 32 of the machine 30 is best seen in FIGS. 1 through 6. The air directing assembly 32 includes an air supply, which is represented by air pipe 62 in FIGS. 1 and 2. The air pipe 62 is attached to an air pump (positive displacement unit) or fan unit (not shown) which provides air to the machine 30 at a predetermined pressure. An air discharge mechanism, represented by discharge conduit 64 in FIGS. 1 and 2 cooperates with vacuum motor for sucking or drawing fiber waste laden air from the machine 30.

Both the air pipe 62 and the discharge conduit 64 cooperate with a manifold 66 which directs the air flow from the air pipe into the machine 30 and directs fiber waste laden air to the discharge conduit for removal from the machine. The manifold 66 is formed from a cross bar 68 and a cover 70.

Figure 5:
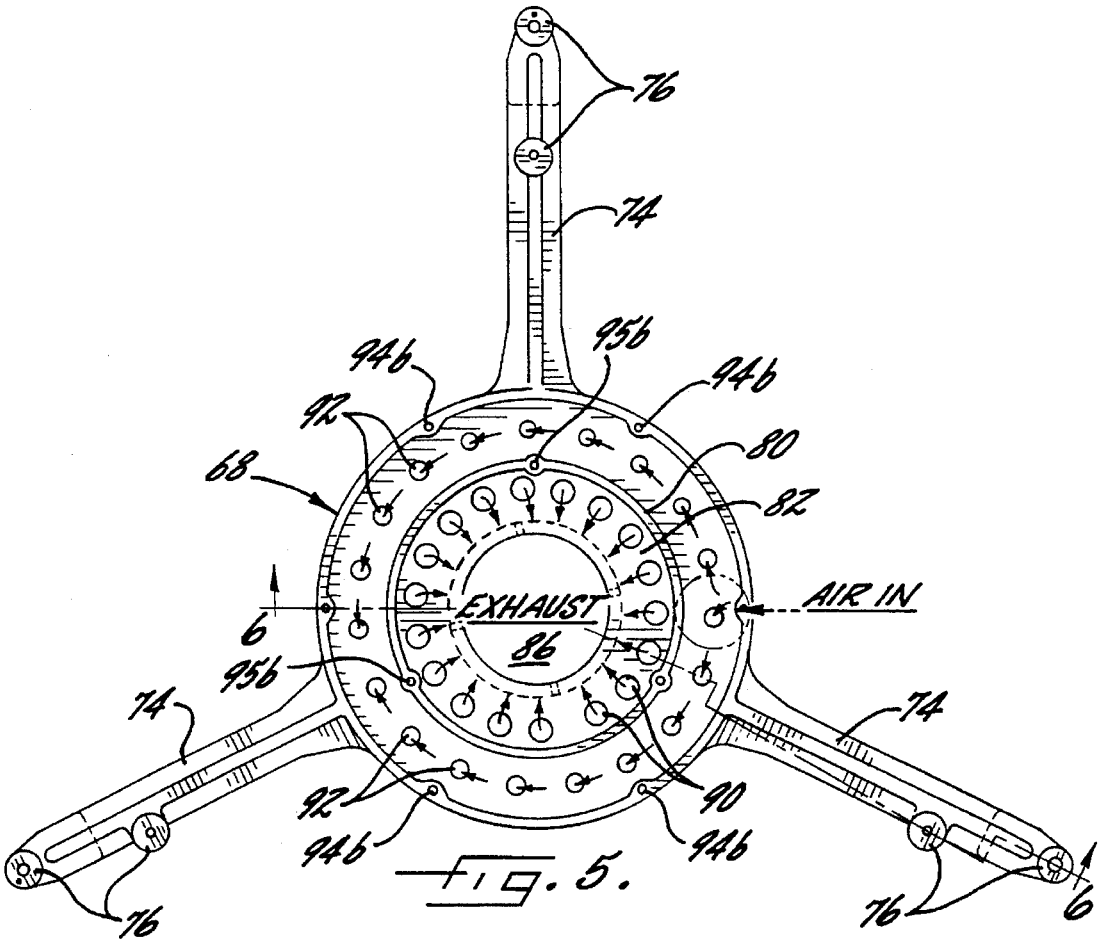
FIG. 5 is a top plan view of the cross bar taken along the line 5—5 of FIG. 2.
Figure 6:
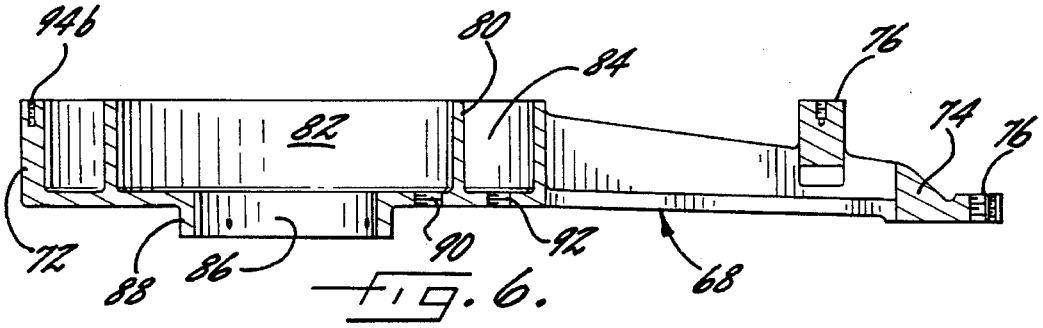
FIG. 6 is a cross sectional view taken along the line 6—6 of FIG. 5.

As best shown in FIGS. 2, 5, and 6, the cross bar 68 has a generally circular body 72 with three attachment bars 74 equally space and extending radially outward therefrom. The attachment bars 74 are attached to the frame 48 by means of fasteners (not shown) which cooperate with mounting apertures 76 located in each of the mounting bars. The body 72 defines a cavity 78 which has an annular divider 80 for separating the cavity into a first plenum 82 and a second plenum 84 when the cover 70 is seated onto the body of the cross bar 68. The annular divider 80 divides the cavity 78 so that the first plenum 82 and the second plenum 84 are concentrically arranged, where the second plenum is located radially outward from the first plenum.

A first cross bar aperture 86 is centrally located in the body 72 and has an attachment flange 88 extending downward therefrom for receiving the exhaust unit 60. A plurality of second cross bar apertures 92 are equally placed along the bottom of the second plenum 84 for directing air from the air supply pipe 62 to the air blowing units 36. A plurality of third cross bar apertures 90, are located radially outward from the first cross bar aperture 86, and are equally spaced along the bottom of the first plenum 82 for receiving fiber waste laden air from the first suction units 38. Fiber waste laden air received from the first suction units 38 and the exhaust unit 60 is directed from the first plenum 82 into the cover 70 and out of the machine 30 as described in detail below.

The cover 70 is seated on the body 72 of the cross bar 68 by fasteners (not shown) which are received in corresponding fastening apertures 94*a* and 94*b*, and 95*a* and 95*b*. The cover 70 is seated on the body 72 to ensure that there is an air-tight seal therebetween so that fiber waste laden air received in the first plenum 82 does not flow or leak into the second plenum 84 which is intended to carry clean air from the air supply pipe 62, into the air blowing units 36 and contaminate the machine 30.

The cover 70 defines a first cover aperture 96 which has a discharge flange 98 extending upward therefrom to receive the air discharge conduit 64. The first cover aperture 96 is in general longitudinal alignment with the first cross bar aperture 86 for directing fiber waste laden air received from first plenum 82 into the air discharge conduit 64 and out of the machine 30. It is to be understood that the fiber waste laden air travels through the air discharge conduit 64 out of the machine and, although not shown, may be filtered to remove and collect the fiber waste and vent the filtered air to atmosphere. A second cover aperture 100, located above the second plenum 84, receives the air supply pipe 62 for supplying air (under a predetermined pressure) into the second plenum. The air is then directed to each of the second cross bar apertures 92 where it is directed to each of the air blowing units 36.

The Exhaust Unit

Figure 7A:
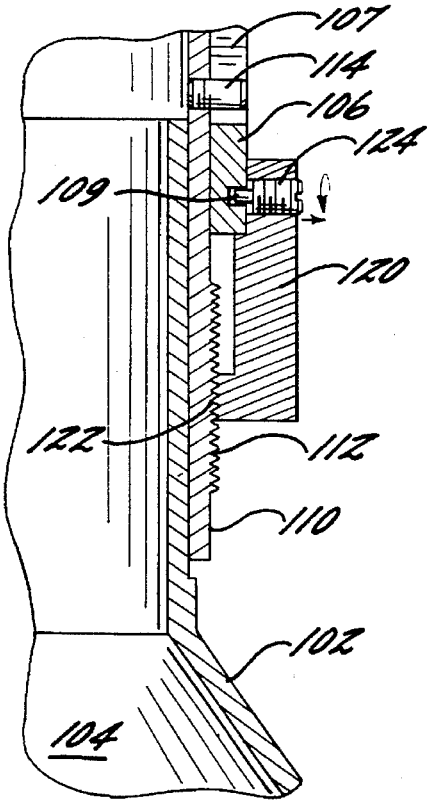
FIG. 7*a* is a partial cross sectional view of the adjustment means showing the exhaust hood in a partially extended position.
Figure 7B:
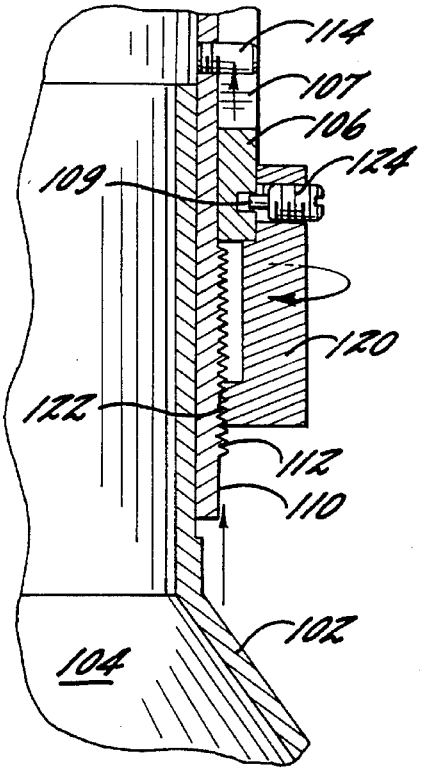
FIG. 7*b* is a view similar to that illustrated in FIG. 7*a* showing the exhaust hood in a substantially retracted position.
Figure 8:
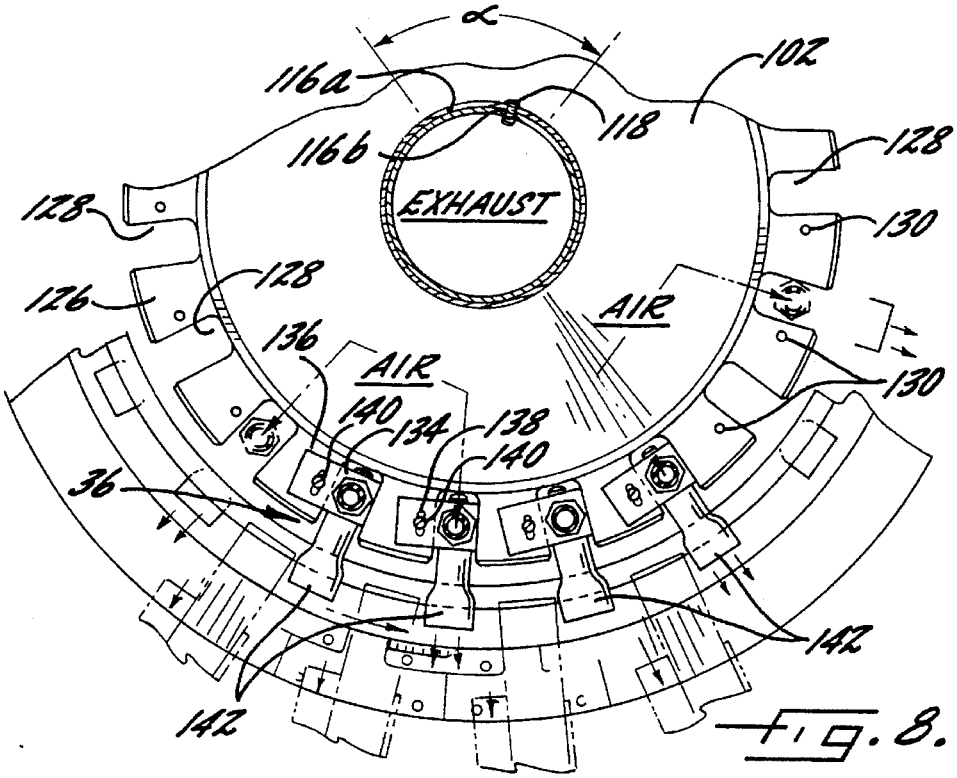
FIG. 8 is a top plan view of the exhaust hood and the support ring taken along the line 8—8 of FIG. 2.
Figure 9:
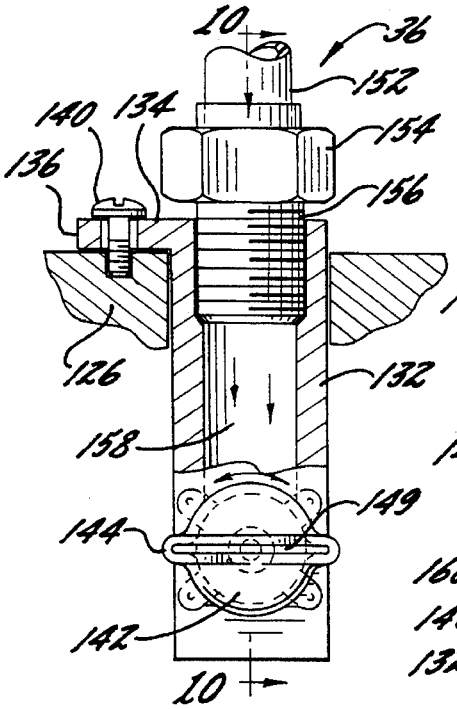
FIG. 9 is a side elevation view of the air blowing unit partially in cross section taken along the line 9—9 of FIG. 2.
Figure 10:
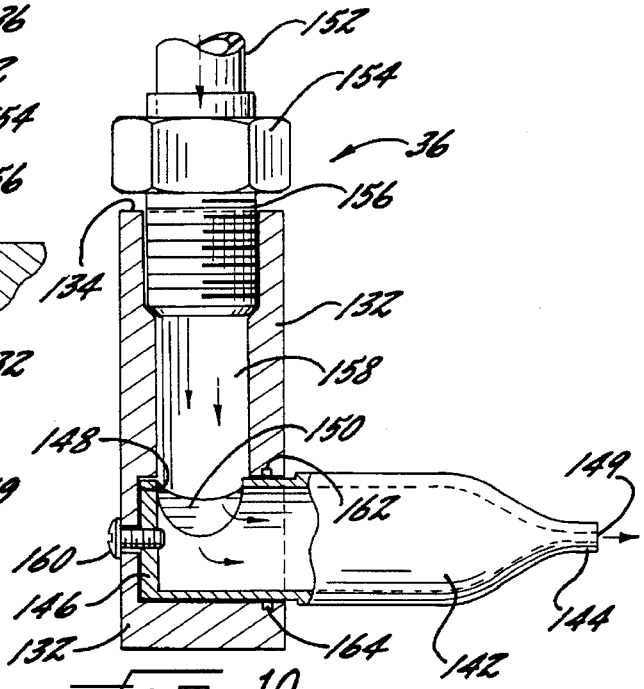
FIG. 10 is a side elevation view of the air blowing unit partially in cross section taken along the line 10—10 of FIG. 9.
Figure 11:
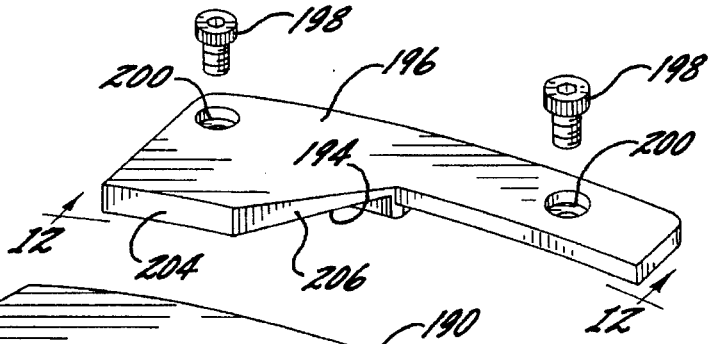
FIG. 11 is a perspective view partially exploded of the sinker unit and latch guard in accordance with the present invention.

The exhaust unit 60 is best shown in FIGS. 2, 7A, and 7B. The exhaust unit 60 includes an exhaust hood 102 which has a generally funnel shape defining a hood opening 104 for sucking fiber waste laden air from the area of the machine 30 radially inward from the blowing units 36. The exhaust unit 60 is secured by an attachment sleeve 106 to the attachment flange 88 of the cross bar 68, by means of fasteners 108. A vertical slot 107 of predetermined length is formed along a portion of the attachment sleeve 106 and a horizontal slot 109 traversing the circumference of the attachment sleeve, is located below the vertical slot 107. Located in between the exhaust hood 102 and the attachment sleeve 106 is a tubular sleeve 110. The tubular sleeve is longitudinally movable relative to the attachment sleeve 106.

The tubular sleeve 110 has a threaded outer surface 112 and located above and projecting outward from the threaded outer surface, is a pin 114. The pin 114 is positioned so as to travel within the vertical slot 107 of the attachment means 106 for limiting the amount of vertical travel of the tubular sleeve 110 relative to the attachment sleeve 106. The tubular sleeve 110 also has a horizontally groove 116*a* of predetermined length along its outer surface. In this embodiment, the groove 116*a* is located below the threaded outer surface 112. A corresponding threaded hole 116*b* is located on the exhaust hood 102. A tightening screw 118 is used to selectively release or tighten the exhaust hood 102 relative to the tubular sleeve 110. By loosening the screw 118, the exhaust hood 102 may be rotated within the predetermined distance about a longitudinal axis parallel to the axis of the plurality of needles 54.

An adjusting ring 120 has a threaded end 122, which threadingly engages the threaded outer surface 112 of the tubular sleeve 110. A set screw 124 located at the other end of the adjusting ring 120, which cooperates with the horizontal slot 109 in the attachment sleeve 106. The threaded end 122 and the set screw 124 cooperate to join the adjusting ring 120 with the tubular sleeve 110 and the attachment sleeve 106.

To adjust the vertical height or elevation of the exhaust hood 102, set screw 124 is loosened, and the adjusting ring 120 is rotated in either the clockwise (to raise) or counterclockwise (to lower) direction. As the adjusting ring 120 is rotated, the set screw tracks within the horizontal slot 109 of the adjustment sleeve 106, preventing relative vertical movement therebetween, while enabling the threaded end 122 of the adjusting ring to rotate along the threaded outer surface 112 of the tubular sleeve 106. Vertically fixing the adjusting ring 120, relative to the attachment sleeve 106, allows the tubular sleeve 106 and the exhaust hood 102, which is attached thereto by the tightening screw 118, to be vertically adjusted as threaded end of the adjusting ring engage the threaded outer surface 112 of the tubular sleeve 110. The range of vertical movement is controlled by the length of the vertical slot 107, in which the pin 114 travels until encountering the end of the vertical slot.

A support ring 126 is cast or formed with the flared head of the exhaust hood 102 to form a unitary structure. Therefore, the exhaust hood 102 and the support ring 126 move together as a single unit. The support ring 126 has a plurality of U-shaped notches 128 located in spaced relation about its peripheral surface. The notches 128 receive the air blowing units 36 described in detail below. Adjacent each of the notches 128 is a mounting aperture 130 for adjustably mounting the air blowing units 36. The rotational adjustment of the exhaust hood 102 relative to the tubular sleeve 110 results in a lateral displacement or movement of each air blowing unit 36, by virtue of being mounted on the support ring 126, relative to the needles 54 of at least three inches.

The threads on the outer threaded surface 112 of the tubular sleeve 110 and the threaded end 122 of the adjusting ring 120 are very fine such that movement of the exhaust hood 102 and the support ring 126 attached thereto, results in a maximum vertical adjustment of the air blowing units 36, relative to the needles 54, of at least one inch. Therefore, it may be seen that any adjustments made to the air blowing units 36 are very fine. Although the adjustments are very fine, any adjustment to the air blowing units 36 has a dramatic effect on the quality and nature of the reverse loop sliver knit fabric being produced. Accordingly, the ability to simultaneously move all of the air blowing units 36 relative to the needles 54 is a major improvement, in time and cost savings, and also accuracy of adjustment, over past techniques which required individual adjustment of each air blowing unit.

The Air Blowing Unit

The present invention incorporates a novel air blowing unit 36 which is best seen in FIGS. 1, 8– 10, and 17. The air blowing unit 36 includes a block 132 having a generally rectangular configuration wherein a longitudinal axis thereof is generally parallel to the plurality of needles 54. A block first end 134 has a mounting flange 136 for mounting the block 132 to the support ring 126. Within the mounting flange 136 is defined a horizontal adjustment slot 138 which cooperates with the mounting aperture 130 for receiving a fastener 140. The cooperation between the fastener 140 and the mounting flange 136 enables the block to be horizontally adjusted for controlling the distance between an air nozzle 142 and the plurality of needles 54. Once the desired distance therebetween has been achieved, the fastener 140 is tightened to secure the block 132 in place. The maximum distance between the air nozzle 142 and the needles 54 is approximately one inch. Accordingly, any horizontal adjustment to air nozzle 142 must be within this limited range.

The air nozzle 142 has a first end 144 located adjacent the needles 54. The air nozzle 142 has a second end 146 which is received within a receiving cavity 148 in the block 132, so as to orient the air nozzle 142 generally perpendicular to the block. A first opening 149 is located in the first end, and a second opening 150 is formed in the second end of the air nozzle 142, to enable air to flow therethrough.

An air supply hose 152 fluidly connects the second plenum 84 of the manifold 66 and the block 132. The air supply hose 152 has a threaded fitting 154 received in a correspondingly threaded aperture 156 located in the first end 134 of the block 132. Between the threaded aperture 156 and the cavity 146 is an air channel 158 enabling air to flow directly from the air supply pipe 62, through the manifold 66, through the air supply hose 152, through the block 132, through the second opening 150 and to the first opening 149 of the air nozzle 142 and onto the needles 54.

In addition to being able to control the distance between the first end 144 of the air nozzle 142 and the needles 54, by means of the cooperation between the mounting flange 136, the horizontal adjustment slot 138, and the fastener 140, the pivotal or rotational orientation of the air nozzle may also be adjusted relative to the needle line. This orientation of the air nozzle 142 relative to the needles 54 may be achieved by cooperation between a screw 160, located on the block 132 adjacent the second end 146 of the air nozzle, a circular groove 162 located in the block adjacent the first end 144 of the air nozzle and an o-ring 164 located on the air nozzle toward the second end thereof.

To adjust the pivotal orientation of the air nozzle 142, the screw 160 is loosened to allow the air nozzle to rotate around its longitudinal axis, such that the o-ring 164 travels within the circular groove 162 preventing any corresponding horizontal movement of the air nozzle. As shown by the phantom lines in FIG. 9, once the desired orientation of the air nozzle has been achieved, the screw 160 is tightened to retain the air nozzle in this position.

Located in between the second plenum 84 of the manifold 66 and the air supply hose 152 is a control valve 166. In FIG. 2 it may be seen that the control valve 166 is fitted into the third cross bar aperture 92 to receive a flow of air from the second plenum 84. The air received therefrom is under a predetermined pressure received from the air supply pipe 62. The control valve 166 is of a mini ball valve type, such that a control knob 168 may control the rate of air flow to the air nozzle 142 ranging between a CLOSED position and an OPEN position. The benefit of using a variable control valve 166 is that it allows the machine 30 operator to individually control the air flow to all or a predetermined number of air nozzles 142. The variable control valve also allows the operator to compensate for any loss in pressure gradient in one or more of the air nozzles 142 by slightly closing those air nozzles not experiences any pressure loss to equalize the flow to all of the air nozzles. In addition, if desirable, for production of different fabrics or variations within a fabric, it is possible to intentionally vary the air flow rate to all or some of the air nozzles 142. Alternatively, it is possible to combine the control valve 166 with an electronic controller to selectively vary the air flow or provide an intermittent air flow when desired.

Unlike prior air jets used in circular sliver knitting machines, the air blowing unit 36 of the present invention is located radially inward from the needles 54 and blows air radially outward in a directly longitudinal and horizontal direction to turn the free end of the sliver X once one or more courses have been knit. A detailed description of the function of the air blowing unit 36 appears below in the section relating to actual production of reverse loop sliver knit fabric.

The First Suction Unit

The first suction unit 38 is best shown in FIGS. 2, and 13 through 15. As shown, the first suction unit 38 consists of a suction nozzle 170 which is attached to one side of the card unit 34. The suction nozzle 170 has an open end 172 adjacent the needles 54 and a closed end 174. The closed end 174 defines an opening 176 for receiving a discharge hose 178. The discharge hose 178 connects the suction nozzle 170 to the first plenum 82 of the manifold 66 to enable fiber waste laden air collected by the suction nozzle to be transported to the air discharge conduit 64. The suction nozzle 170 also has a notch 180 located therein, to assist in the removal of fiber waste from the doffer roll or wheel 184.

Figure 16:
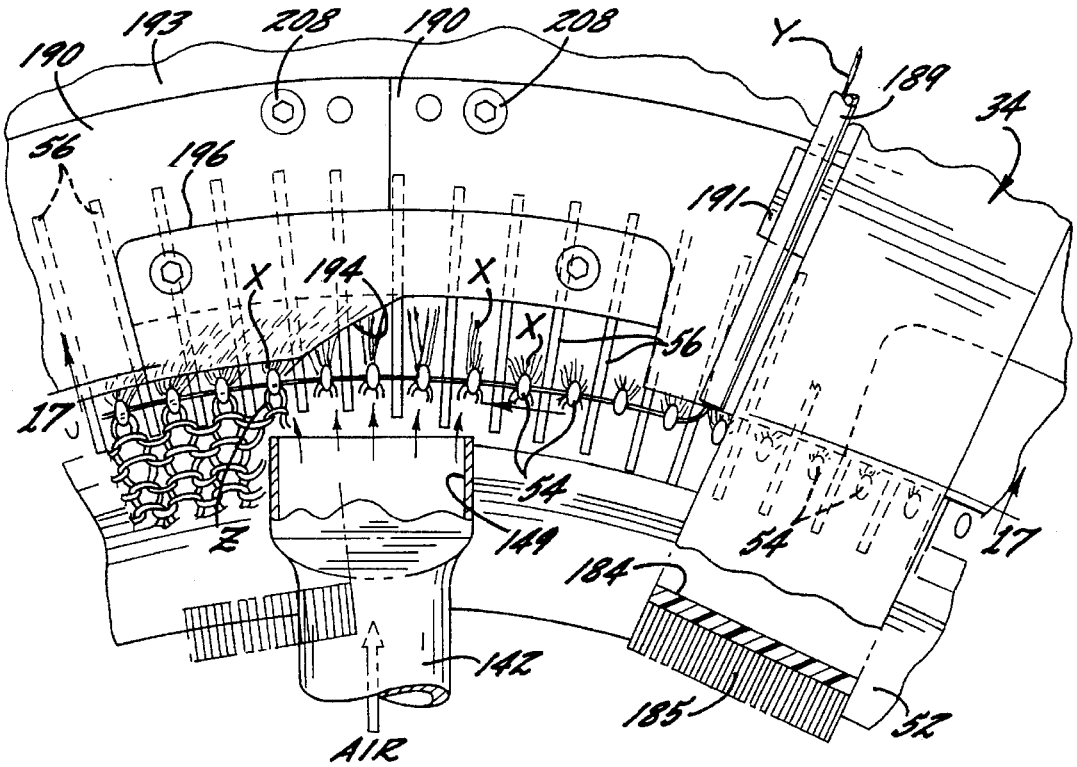
FIG. 16 is a top plan view illustrating the knitting action and relationship of various elements in accordance with the present invention.

The orientation of the air blowing unit 36, as set forth in the present embodiment of the invention, has resulted in the addition of a first suction unit 38. As illustrated in FIG. 16, the orientation of the suction nozzle 170 is such that it is located radially outward and laterally offset from the air nozzle 142. The first suction unit 38 is connected, by means of a fastener 181, to the card unit 34. The advantage of positioning the first suction unit 38 adjacent the card unit 34 is that fiber waste blown radially outward by the air blowing unit 36, would otherwise become trapped in the sinkers 56 and the card unit 34.

The use of the first suction unit 38 in conjunction with each card unit 34 eliminates much of the fiber waste radially outward of the air blowing units 36. The fiber waste located radially inward of the air blowing units 36 is substantially eliminated by the exhaust unit 60 (i.e., the second suction means). Therefore, the cooperation between the first suction unit 38 and the exhaust unit 60 results in an efficient method of eliminating fiber waste generated by the production from the machine 30. This is especially important in light of the fact that as many as eighteen card units are capable of being operated simultaneously (as is shown in the present embodiment of the invention).

The Card Unit

Figure 13:
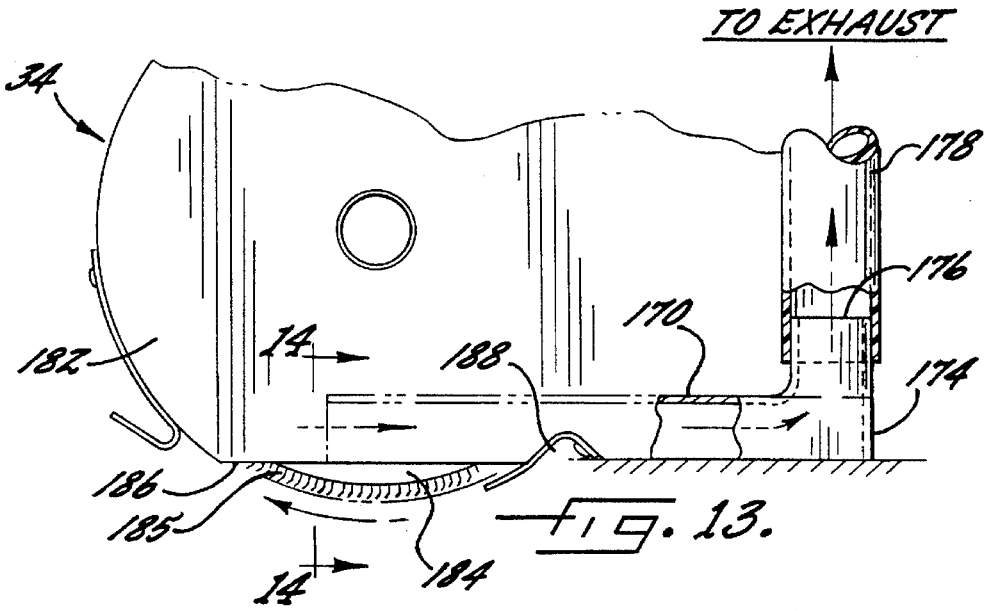
FIG. 13 is a partial side elevation view of a sliver card unit in accordance with the present invention.
Figure 14:
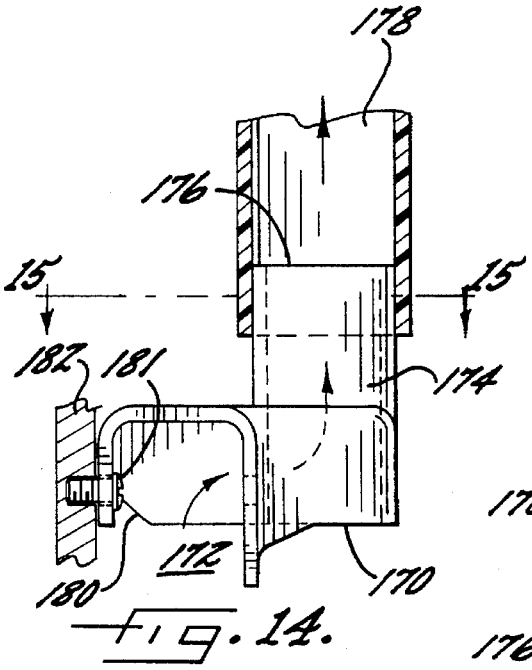
FIG. 14 is an end view in partial cross section taken along the line 14—14 of FIG. 13.
Figure 15:
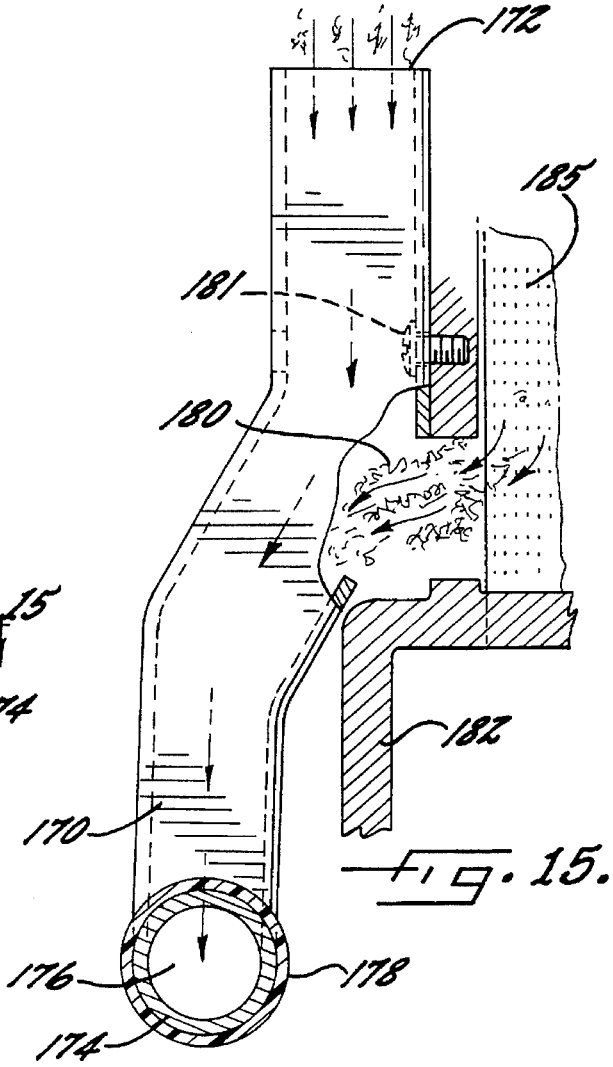
FIG. 15 is a top plan view in partial cross section taken along the line 15—15 of FIG. 14.

As illustrated in FIGS. 1, 2, and 13, the card unit 34 of the present invention has a card unit housing 182 rotatably retaining a doffer roll 184. The card unit 34 feeds sliver fibers X to a wire face 185 of the doffer roll 184, for presenting the sliver fibers to the needles 54 as the needles pass therethrough.

The card unit housing 182 has a substantially flat base 186 in general horizontal alignment with the suction nozzle 170. The base 186 includes a notch 188 which cooperates with the notch 180 of suction nozzle 170, to improve the removal of fiber waste from the card unit housing 182 and beneath the doffer roll 184.

A yarn feeding tube 189 is connected to the sinker unit 190 by a block 191 to prevent the yarn feeding tube from vibrating during operation of the machine 30. A fastener (not shown) secures the yarn feeding tube 189 to a card support ring 193 radially outward from the sinker units 190. The yarn feeding station 58 fees yarn Y through the yarn feeding tube 189 to the needles 54 after they have taken sliver fiber X from the wire face 185 of the doffer roll 184.

The Sinker Units/Latch Guard Assembly

Figure 12:
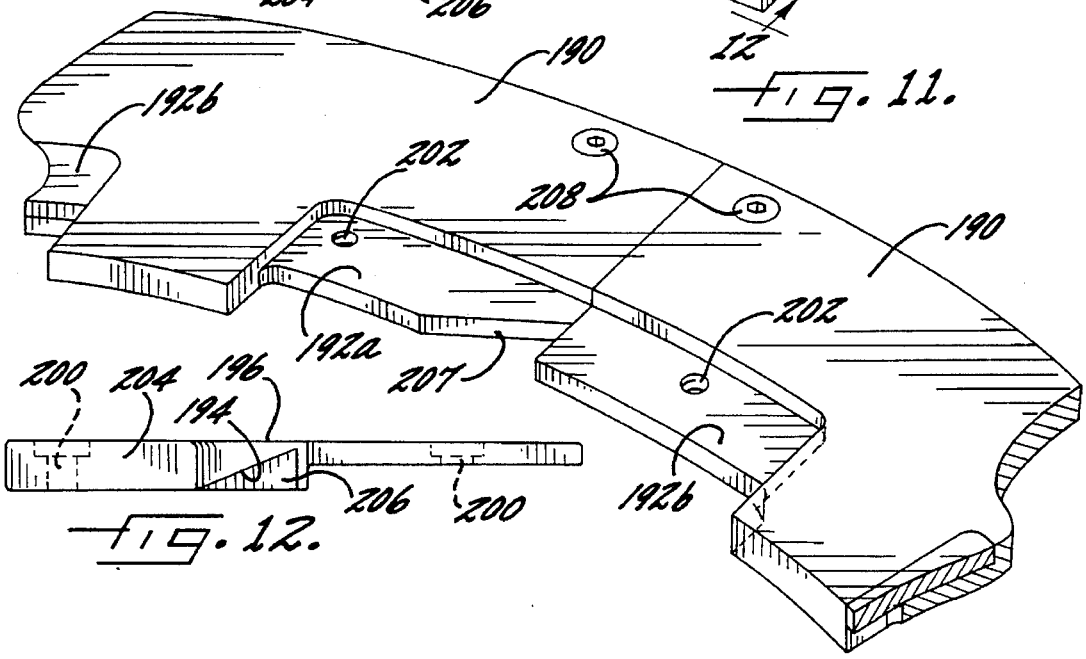
FIG. 12 is a side elevation view of the latch guard taken along the line 12—12 of FIG. 11.

As illustrated in FIGS. 12 and 16, sinker units 190 of the present invention have a generally rectangular shape. However, unlike prior sinker units 190' shown in FIG. 25, the sinker units 190 of the present invention, have a pair of recessed platforms **192*a* and 192*b* located along an edge of the sinker units adjacent the needles 54. One of the recessed platforms, in this embodiment 192*a*, has an angled section 194**, wherein the section approaches an angle of 45°.

A latch guard 196 corresponding in size to the recessed platforms **192*a* and 192*b* is secured thereto, in adjoining sinker units 190, by means of threaded fasteners 198 received in corresponding holes 200 in the latch guard and threaded holes 202 in the respective sinker units 190. An angled section 206 is located in a front edge 204 of the latch guard, such that the section corresponds in size, shape, and location to the section 207 in the sinker units 190. The sinker units 190 are secured to the frame 48 by means of fasteners 208**.

Figure 25:
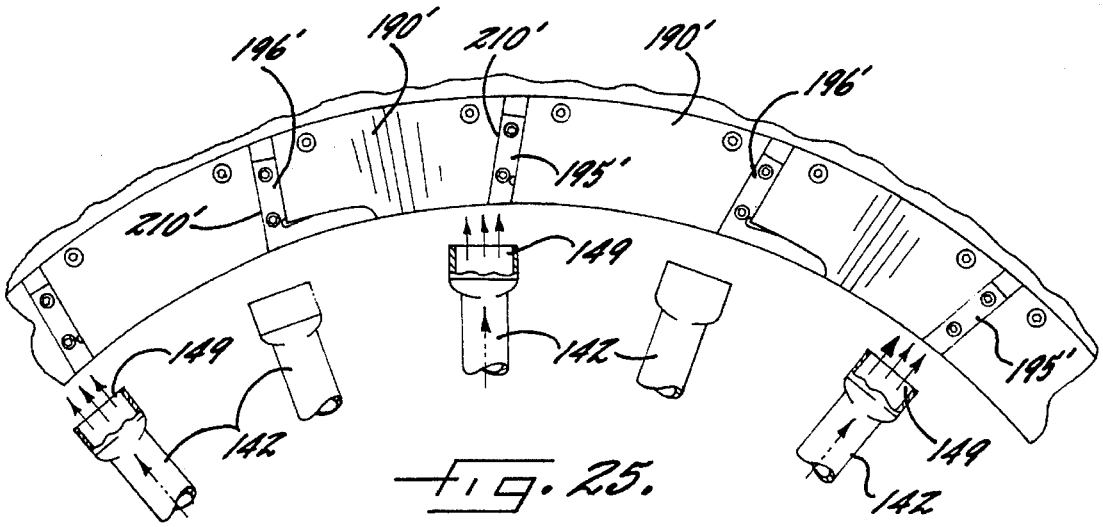
FIG. 25 is a top plan view of a prior art sinker unit and latch guard arrangement.

The orientation of the air blowing unit 36 relative to the card unit 34 presents a heretofore unknown problem in circular sliver knitting machines. As shown in FIG. 25, by blowing air radially outward toward the needles 54 and the sinkers 56, the fiber waste became lodged or trapped in spaces between prior sinker units 190' and prior latch guards 195'. To overcome this problem, the relationship of the sinker units 190 and latch guard 196 has been changed as shown best by comparing FIGS. 16 and 26 with FIG. 25.

In the present invention, the connection of the latch guard 196 and the sinker units 190 results in a seam 210 which does not radially extend across the entire width of the sinker units. Rather, the edge closest to the needles 54 is covered entirely by the latch guard 196. The result is that there is no leading edge to the seam 210, thereby preventing the fiber waste from becoming trapped. As shown in FIG. 25, prior connections between the sinker units 190' and the latch guard 196' resulted in a seam 210' which extended the full width of the sinker units 190' enabling fiber waste to become trapped.

Figure 26:
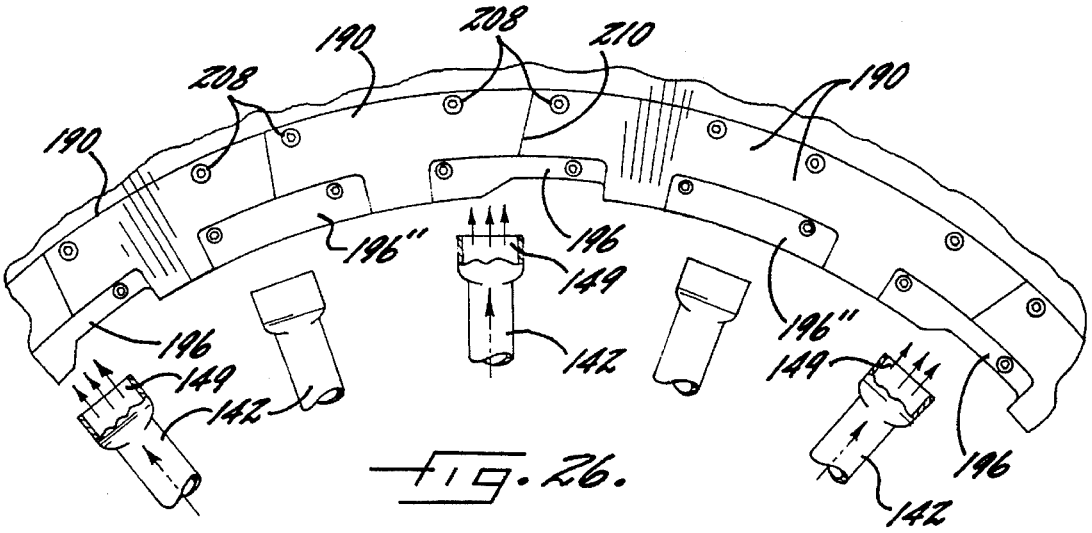
FIG. 26 is a side elevational view of sinker units/latch guard assembly in accordance with the present invention.

An alternative latch guard 196", as shown in FIG. 26, is used to join a pair of sinker units 190 in either a non-knitting card unit 34 position or in a knitting card unit position if the reverse loop sliver knit fabric to be produced is a jacquard knit pattern. The purpose of the corresponding sections 206 and 207 in the sinker units 190 and the latch guard 196, respectively will be discussed in detail below in the context of manufacturing reverse loop sliver knit fabric.

The Process Of Manufacturing Reverse Loop Sliver Knit Fabric

1. Pre-Production Activity

Prior to actually manufacturing reverse loop sliver knit fabric on the present machine 30, it is desirable that some pre-production activity occur to ensure that the reverse loop sliver knit fabric is of the highest quality. This pre-production activity is also necessary because of the wide variety of fabrics and/or variations within a fabric which may be produced on the machine 30. For example, depending on the type of reverse loop sliver knit fabric which will be made i.e., bouclé, corduroy, fleece, jacquard, or some other variation of fabric which is now possible on the machine 30, different adjustments may need to be made.

For purposes of illustration only, it will be assumed that the reverse loop sliver knit fabric to be manufactured or produced is to be a single-faced fleece. Those skilled in the art to which this invention relates understand that the description of the knitting process will vary depending on the type of fabric and the related variations thereto. For example, the production of full jacquard fabric requires a different latch guard 196" (described below) as well as different machine settings. It is assumed for purposes of the description, that the initial calibration or adjustment of each of the air nozzles 142 relating to its rotational orientation and its horizontal distance from the needles 54 has been performed, as described in detail above, to the satisfaction of the machine 30 operator. In addition, for purposes of this example, it is to be understood that all eighteen card units 34 on the machine 30 are to be used and that only nine of the eighteen available air blowing units 36 will be used. The process to be described below is illustrated in FIGS. 16 through 24.

Assuming that prior experimentation has been performed to determine the appropriate settings necessary to obtain the type of fleece to be produced, it is first necessary to turn the control knob 168 on the control valve 166 of every other air blowing unit 36 to the CLOSED position. By only using every other air blowing unit 36 (i.e., nine of the eighteen possible blowing units), as shown schematically in FIG. 24, two courses will be knit on each needle 54 before travelling adjacent an active air blowing unit.

It is to be understood that it is also possible to knit only one course or, if desired, to knit three or more courses on each individual needle 54 before travelling in front of an active air blowing unit 36. The number of courses knit on a needle 54 before travelling in front of an active air blowing unit 36 determines the size of the loop to be formed in the fabric. It is also possible to adjust each of the nine air blowing units 36 which are to be used to compensate for any loss in air flow pressure, by moving the control knob 168 somewhere between the CLOSED position and the OPEN position to ensure that each air blowing unit has the same amount of air flow. If desired, the control knob 168 may be used to intentionally vary the air flow among the air blowing units 36 to be used.

It is also important to adjust the height or vertical alignment of the air nozzles 142 relative to the needles 54. This adjustment (lateral and/or vertical) is performed by manipulating the adjusting ring 120 relative to the attachment sleeve 106 and the tubular sleeve 110 for vertical adjustment, and by rotating the exhaust hood 102 relative to the tubular sleeve for lateral adjustment. Once these adjustments to the air blowing units 36 have been made and the desired sliver and yarn have been feed into the eighteen card units 34 and the yarn feeding stations 58, the actual production of reverse loop sliver knit fabric can begin.

2. Producing Reverse Loop sliver Knit Fabric

The sequence for producing reverse loop sliver knit fabric from sliver fibers X and yarn Y, is best understood by FIGS. 18 through 24. To simplify the explanation, each card unit 34 has been designated as A, B, C or D. In the embodiment to be described for illustration purposes only, the activity occurring at card units A and C is the same and the activity occurring at card units B and D is the same. It is to be understood that the production of different types of reverse loop sliver knit fabrics would result in different activity occurring throughout the sequence described below. It is also to be understood that the needles 54 are rotating with the needle cylinder 52 and simultaneously travelling between a clearing level (see FIG. 18) and a cast-off level (see FIG. 22), in the sinusoidal path previously described.

Figure 24:
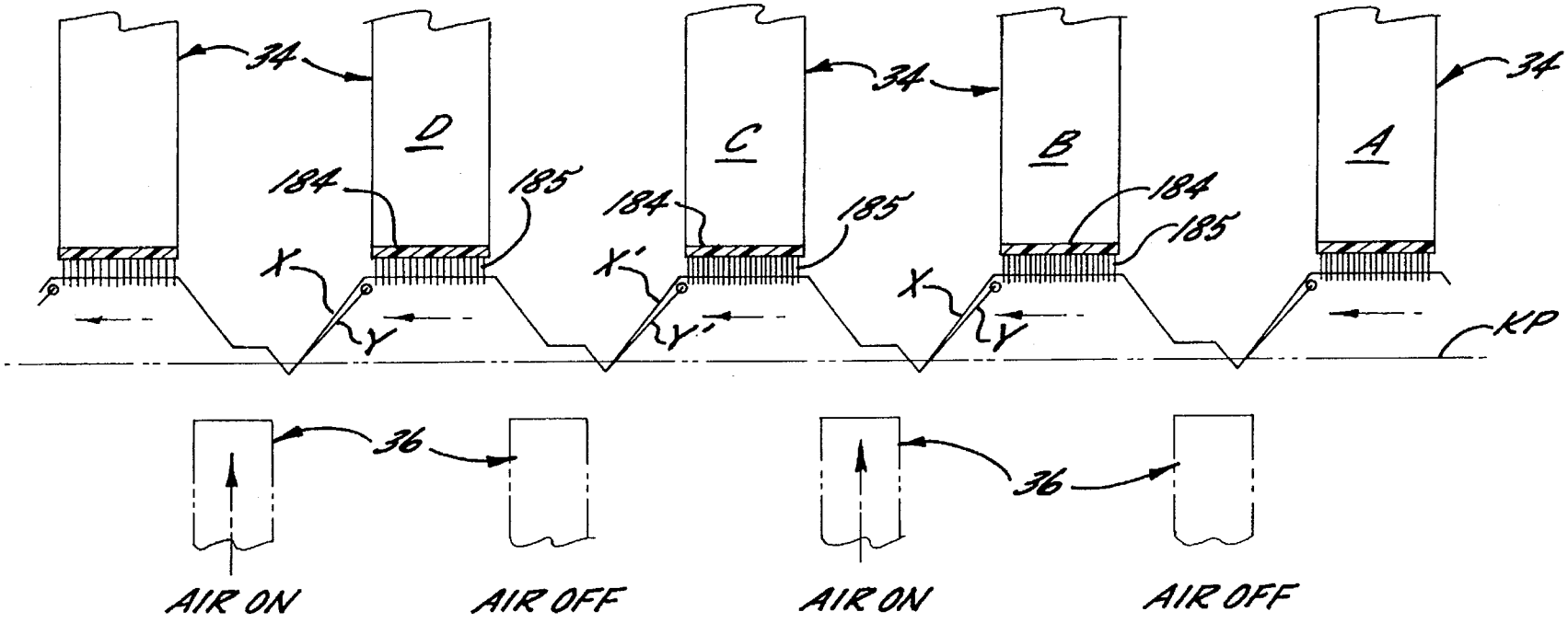
FIG. 24 is a schematic representation of the knitting action in accordance with the present invention.

As represented schematically in FIG. 24 by card unit A, the needles 54 begin a first knitting cycle by travelling through the wire face 185 of the doffer roll 184 at card unit A, where each needle picks up a tuft of sliver fabric X. As the needles 54 travel out of the doffer roll 184, the needles are fed a first yarn Y from the yarn tube 189 of the yarn feeding station 58. The needles 54 then begin to descend from the clearing level toward the cast-off level.

Figure 22:
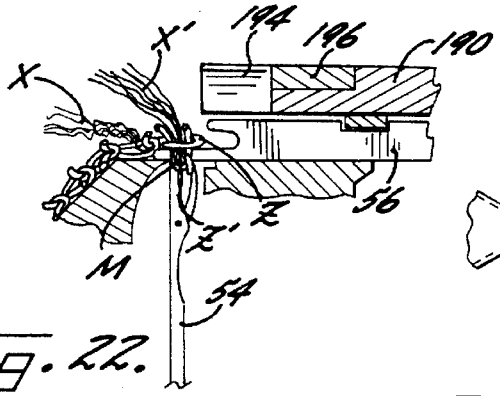
FIG. 22 is a partial cross section view taken along the line 22—22 of FIG. 17.
Figure 23:
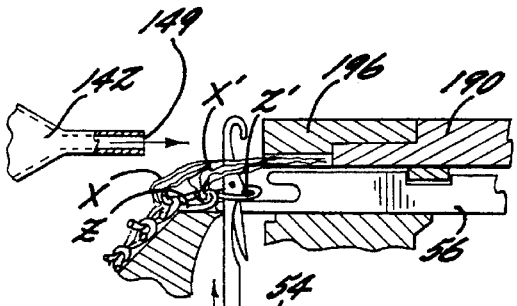
FIG. 23 is a partial cross section view taken along the line 23—23 of FIG. 17.

The needles 54 continue to descend, passing through a knitting plane, represented by KP in FIG. 24, until a stitch is made, as shown in FIG. 22 which ties down or anchors a medial portion M of the sliver fabric X. With reference to FIG. 22, a first course Z is made by having the sinker 56 move away from the needle 54, allowing the yarn to be knitted down over the throat area of the sinker, thereby anchoring the medial portion M of the sliver fiber X with yarn Y, while allowing free ends of the sliver fiber to be positioned adjacent the needle. As the needle 54 ascends from the cast-off position, the sinker 56 again moves into the knock over position, (not shown) with the needle to hold down the first course Z.

Figure 18:
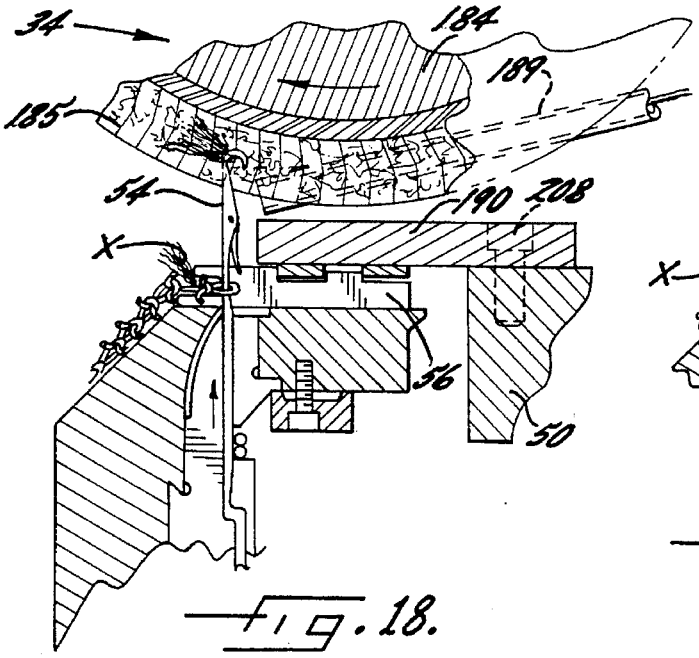
FIG. 18 is a partial cross sectional view taken along the line 18—18 of FIG. 17.
Figure 19:
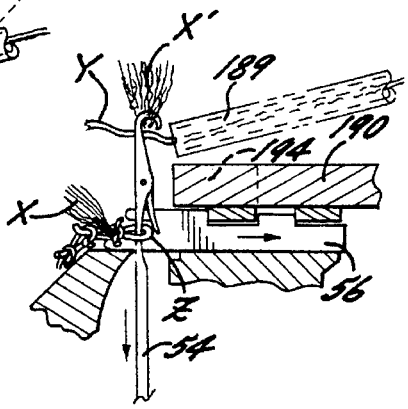
FIG. 19 is a partial cross sectional view taken along the line 19—19 of FIG. 17.

The first course having been knit between card units A and B, the needle 54 again ascends to the clearing level at card unit B, as shown in FIG. 18, to pick up a second tuft of fiber X'. As this occurs, the first course Z is retained by the sinker 56 on the needle, below the knitting plane KP. Progressing sequentially through FIGS. 19 through 22, it is shown how a second course Z' is knit between card units B and C in the same manner as the first course Z. FIG. 19 shows the needle 54 leaving the card unit B with a second tuft of sliver fiber X' and receiving a second yarn Y'.

Figure 20:
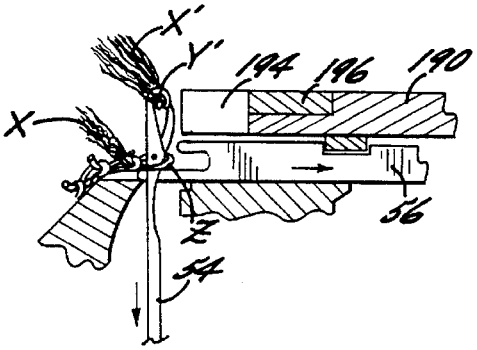
FIG. 20 is a partial cross sectional view taken along the line 20—20 of FIG. 17.
Figure 21:
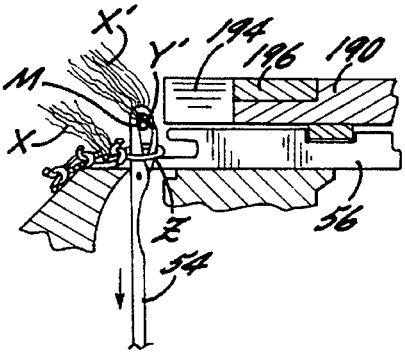
FIG. 21 is a partial cross sectional view taken along the line 21—21 of FIG. 17.

As shown in FIG. 20, the needle 54 continues to descend toward the cast-off level with the sinker 56 retaining the first course Z in proper position. The free ends of the second sliver fibers X' are located in the proper position, an angle approaching 45° radially inward from the card unit B. The needle 54 continues to travel downward in FIG. 21 as the sinker 54 begins to move out of the way drawing the first course Z adjacent the second sliver fibers X' and the second yarn Y'. FIG. 22 shows the knitted stitch being completed to form a second course Z' as previously described in reference to the first course Z. The knitting of the second course Z' is formed between the card units B and C, and completes the second knitting cycle.

Unlike past approaches to making a reverse loop fabric, the present invention enables the free ends of the sliver fibers X to be knit as second or possibly third time because of an improvement to the machine 30. As described below, this ability to knit the free ends of the sliver fibers X a second time or more, results in an improved quality fabric. As shown in FIGS. 16 and 17, and 23 and 24, the two knitted courses Z and Z' are introduced to the air blowing unit 36 which has its control valve 168 in the ON position. As the needle 54 ascends to the clearing level for a third time, the needle cylinder 52 carries the needles 54 passed the air blowing unit 36.

Figure 17:
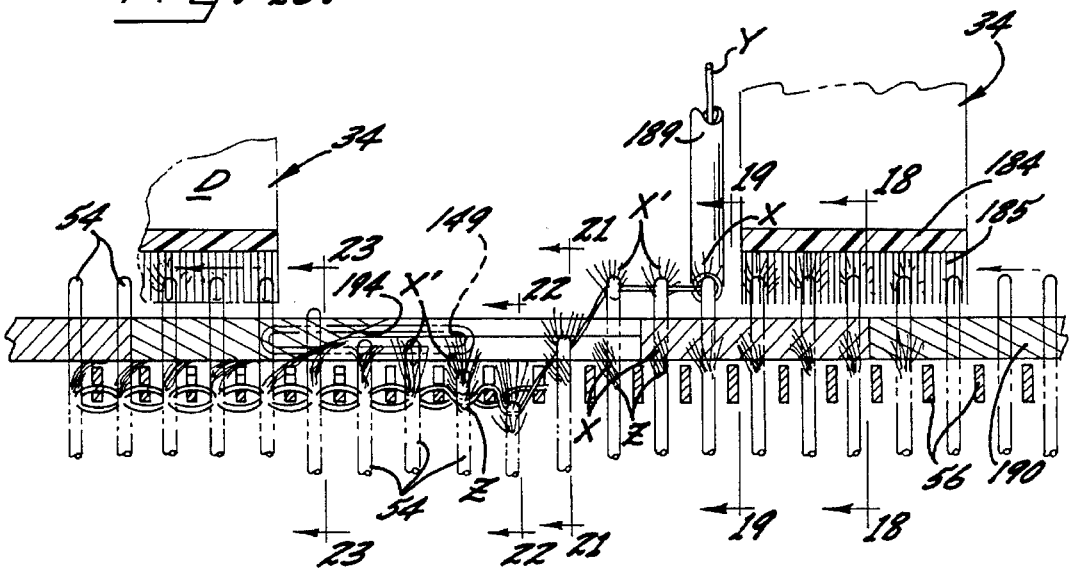
FIG. 17 is a side elevation view illustrating the knitting action in accordance with the present invention.

The air blowing unit 36 causes the orientation of both courses Z and Z' to change from the position shown in FIGS. 16 and 17, to the position shown in FIG. 16 and in FIG. 17 between the lines 22—22 and 23—23. Stated another way, the air blowing unit 36 causes the free ends of the courses Z and Z' to move from a 45° position to the front side of the needle 54 i.e., in the direction of rotation of the needle cylinder 52, to a position radially outward from the needles, in the same direction the air is travelling from the air blowing unit. This movement of the courses Z and Z' is termed turning over of the courses, as best shown in FIGS. 16 and 17.

The turning over of the courses Z and Z' causes the free ends thereof to lay across the adjacent latch guard 196. As the needles 54 continue to rotate with the needle cylinder 52, and as the needles simultaneously continue to ascend toward the clearing level at card unit C, the free ends of the courses Z and Z' are dragged or directed across the surface of the latch guard 196 until the free ends come into contact with the angled section 206 of the latch guard. The combined efforts of the sinkers 56, which prevent the courses Z and Z' from moving above the knitting plane KP, the angled section 206 of the latch guard 196, and the corresponding angled section 207 of the sinker units 190, guide the free ends of the courses along the angled sections, below the latch guard (see FIG. 23) and onto the adjacent sinkers, directly behind the respective needles. The free ends of the courses Z and Z' are positioned on the sinkers 56 in a uniform and controlled manner at an angle approaching 45°, as shown best in FIGS. 16 and 17, thereby completing the knitting cycle.

The result of this orientation of the free ends of the courses Z and Z' is that the free ends may subsequently be knit into the fabric a second time by an adjacent (following) needle 54 in combination with another tuft of sliver fiber (not shown) picked up at card unit D. This results in the free ends of the sliver X being knit in conjunction with an adjacent needle 54 which is both at least one course higher than the second course Z' but also at least one wale over from the second course Z'. As a consequence, the second and possibly third knitting of the free ends of the sliver fibers X and X' will occur diagonally from the original courses Z and Z'. The benefit of this approach is best understood in the context of a completed fabric.

As is well known by those skilled in the art, a completed reverse loop fabric has a jersey knitted web on one side (not shown) and a loop pile on the other (not shown). The desired outcome of reverse loop fabric production is to have a uniform loop pile size. However, by its very nature, the sliver fiber X cannot be picked up by the needle 54 from the doffer roll 184 in the medial portion M of the sliver fiber strand. Therefore, as the sliver fiber X is knitted into the fabric by the yarn Y into U and or J loops, the lengths of the free ends of the courses Z and Z', vary dramatically. As a result, it is necessary for an acceptable product that the reverse loop fabric undergo a finishing process.

3. The Finishing Process

Although not actually part of the present invention, the benefits of the machine 30 and the resultant fabric produced thereon may only be properly understood by comparing the finishing process of the present invention and that of prior circular sliver knitting machines. As discussed above, the typical reverse loop fabric has a pile length (corresponding to the free end of knitted courses) which varies dramatically because each tuft of sliver fiber has usually only been knitted into the fabric once. To obtain a reverse loop fabric which may be used in production of clothing, it is necessary to first obtain a pile of uniform length. The method of obtaining a pile of uniform height is to find the lowest common height of the loop (corresponding to the size of the loop knit which is usually determined by the customer) and then shear the entire face of the fabric to that height. The shearing of the pile to obtain a common height typically results in removing between forty (40) and sixty (60) percent of the sliver fibers X. Accordingly, usually at least one half of the knitted sliver fiber X ends up as waste. After shearing the pile to the desired length, the fabric is napped or brushed to obtain the fleece look and minimize the appearance of any imperfections in the fabric.

Unlike the prior produced fabrics, the present invention produces a superior reverse loop fabric. The ability to uniformly guide the free ends of the courses Z and Z' over the sinker 52 allows the free ends to be knitted into the fabric a second or third time, resulting in a very uniform pile length of the finished fabric. The resultant fabric often does not have to be sheared or if sheared only minimally. As a consequence of not having to shear or only minimally shear the fabric, is a saving approaching sixty (60) percent of the sliver fibers X, a dramatic improvement over all previous techniques.

In addition, the associated time saved by not having to shear or perform minimal shearing results in decreased production costs. Like prior approaches, the fabric of the present invention is napped or brushed to obtain a finished product. A comparison of the finished fabric produced on the machine 30 of the present invention and fabric currently available, shows that the improvements are significant.

Many modifications and other embodiments of the invention will come to mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

What is claimed is:

1. A manifold for use with a circular sliver knitting machine of the type having a frame for rotatably supporting a needle cylinder, said needle cylinder having a plurality of needles vertically movable along a predetermined path relative thereto, a yarn and sliver fiber feeding station, and a plurality of sinkers cooperating therewith for forming sliver fibers into knitted fabric, and having an air supply and an air discharge unit, said manifold comprising:

a body defining a first aperture adapted to exhaust fiber waste laden air, a second aperture adapted to receive air from said air supply, and said body defining a cavity and an annular divider for dividing said cavity;

a cover secured to said body forming a seal therebetween, said cover cooperating with said body and said annular divider for forming therebetween as parts of said cavity a first plenum and a second plenum, said cover defining a first cover aperture adapted to exhaust said fiber waste laden air, and said cover defining a second cover aperture adapted to receive air from the air supply; and attachment means for attaching said body to the circular sliver knitting machine.

2. A manifold according to claim 1 wherein said body further defines a third aperture for receiving additional fiber waste laden air and a fourth aperture adapted for exhausting air from the air supply.

3. A manifold for use with a circular sliver knitting machine of the type having a frame for rotatably supporting a needle cylinder, said needle cylinder having a plurality of needles vertically movable along a predetermined path relative thereto, a yarn and sliver fiber feeding station, and a plurality of sinkers cooperating therewith for forming sliver fibers into knitted fabric, and having an air supply unit and an air exhaust unit, said manifold comprising:

a body defining a generally cylindrical cavity and an annular divider for dividing said cavity, said body defining a first aperture adapted to exhaust fiber waste laden air from the air exhaust unit, a second aperture adapted to receive air from said air supply, and a third aperture for exhausting additional fiber waste laden air;

a cover secured to said body forming a seal therebetween, said cover cooperating with said body and said annular divider for forming therebetween as parts of said cavity an annular first plenum and an annular second plenum, said cover defining a first cover aperture adapted to exhaust said fiber waste laden air, and said cover defining a second cover aperture adapted to receive air from the air supply; and attachment bars integrally formed with said body for attaching said body to the circular sliver knitting machine.

4. A manifold for use with a circular sliver knitting machine of the type having a frame for rotatably supporting a needle cylinder, an air supply, an air suction unit, and an air exhaust unit, said manifold comprising:

a body having attachment bars integrally formed therein for attaching said body to the circular sliver knitting machine, said body defining a cavity having an annular divider located therein for dividing said cavity, said body further defining a first aperture adapted to exhaust fiber waste laden air from the air exhaust unit, a second aperture adapted to receive air from the air supply, and a third aperture for exhausting additional fiber waste laden air from the air suction unit; and a cover secured to said body and cooperating therewith and with said annular divider for forming therebetween as parts of said cavity a first plenum and a second plenum, and said cover defining a first cover aperture adapted to exhaust said fiber waste laden air from said first plenum and a second cover aperture adapted to receive air from the air supply.

* * * * *

UNITED STATES PATENT AND TRADEMARK OFFICE

CERTIFICATE OF CORRECTION

PATENT NO. : 5,497,531

DATED : March 12, 1996

INVENTOR(S) : Kuhrau et al.

It is certified that error appears in the above-identified patent and that said Letters Patent is hereby corrected as shown below:

On the title page: Item [56] References, Foreign Patents, No. 3, "2/1978" should be -- 11/1978 -- .

On the cover page, column 2, References, Foreign Patents, No. 5, "3/1988" should be -- 12/1989 --.

Column 7, line 3, after "with" insert -- a --.

Column 13, line 22, "sliver" should be -- Sliver --.

Signed and Sealed this

Twenty-fifth Day of June, 1996

Bruce Lehman

*Attest:*

BRUCE LEHMAN

*Attesting Officer*

*Commissioner of Patents and Trademarks*